US006737211B2

(12) United States Patent
Hayashi et al.

(10) Patent No.: US 6,737,211 B2
(45) **Date of Patent: *May 18, 2004**

(54) COLOR TONER

(75) Inventors: Kazuyuki Hayashi, Hiroshima (JP); Keisuke Iwasaki, Hiroshima (JP); Hiroko Morii, Hiroshima (JP)

(73) Assignee: Toda Kogyo Corporation, Hiroshima-ken (JP)

( * ) Notice: Subject to any disclaimer, the term of this patent is extended or adjusted under 35 U.S.C. 154(b) by 72 days.

This patent is subject to a terminal disclaimer.

(21) Appl. No.: 10/131,501

(22) Filed: Apr. 25, 2002

(65) Prior Publication Data

US 2003/0022085 A1 Jan. 30, 2003

(30) Foreign Application Priority Data

Apr. 27, 2001 (JP) ..... 2001-133694

(51) Int. Cl.[7] ..... G03G 9/09

(52) U.S. Cl. ..... 430/108.11; 430/108.1; 430/110.1

(58) Field of Search ..... 430/108.11, 108.1, 430/110.1

(56) References Cited

U.S. PATENT DOCUMENTS

| | | | | |
|---|---|---|---|---|
| 4,576,888 | A | 3/1986 | Miyakawa et al. | |
| 5,102,763 | A | 4/1992 | Winnik et al. | |
| 2003/0138714 | A1 * | 7/2003 | Hayashi et al. | 430/108.3 |

FOREIGN PATENT DOCUMENTS

| | | |
|---|---|---|
| EP | 1 106 657 A2 | 12/2000 |
| EP | 1 184 426 A2 | 3/2002 |

* cited by examiner

*Primary Examiner*—Mark A. Chapman
(74) *Attorney, Agent, or Firm*—Nixon & Vanderhye P.C.

(57) ABSTRACT

A color toner comprises: a binder resin, and a colorant having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

The color toner exhibits not only a clear hue, but also excellent fluidity and dispersibility of colorants.

12 Claims, No Drawings

COLOR TONER

BACKGROUND OF THE INVENTION

The present invention relates to a color toner, and more particularly, to a color toner exhibiting not only a clear hue, but also excellent fluidity and dispersibility of colorants.

In recent years, color photographs as well as colorful documents and data have been increasingly used for both domestic and business purposes. With the wide spread of personal computers, there have been many opportunities for directly editing color photographs and color images. When these color photographs and color images are printed or copied, there have been increased needs for producing color prints or color copies with clear hues rather than monochromic ones.

Upon color printing, exact and faithful reproduction of images and colors, high image quality of obtained color prints and high-speed printers have been required. In addition, it has also been required that the printed image quality can be maintained for a long period of time without deterioration.

As conventional color electrophotographic developing methods, there are known a two-component developing method and a non-magnetic one-component developing method. In the two-component developing method, respective toners of cyan, magenta, yellow and black colors are brought into frictional contact with a carrier in order to impart an electric charge having a sign opposite to that of an electrostatic latent image to the toners, and cause the toners to adhere to the latent image by electrostatic attraction force therebetween and neutralize the electric charge, thereby developing the latent image into visual color image. As the toners used in such a developing method, there have been widely used composite particles obtained by mixing and dispersing organic pigments having respective colors in a binder resin.

Since the color printing is performed by overlapping a plurality of the color toners to obtain a desired color, it is required to more strictly control qualities of the respective color toners than black toner upon monochromic printing, in order to exactly reproduce a clear color image. Therefore, it has been strongly required to improve properties of the color toners.

It is known that the color toners are produced by blending organic pigments as colorants in resins. In addition, there is known a color toner containing magnetic particles coated with white pigments or color pigments (Japanese Patent Application Laid-Open (KOKAI) Nos. 58-25643(1983), 60-173553(1985) and 7-90310(1995)).

It is also known that developing characteristics are largely influenced by the colorant exposed to the surface of each color toner particle. Thus, there is a close relationship between various properties of the color toner and those of the colorant mixed and dispersed therein.

Namely, since hues and densities of the color toner largely depend upon those of the colorant contained therein, the colorant itself has been strongly required to show an excellent hue.

To satisfy the needs for high image quality, there is an increasing tendency that the color toner becomes finer. Such a fine color toner is also required to show the same hue between the color toners by uniformly blending a colorant therein. Therefore, the colorant must have an excellent dispersibility in the toner.

Further, in order to obtain clear color images, the color toner is required to act as independent particles without agglomeration. For this reason, conventional color toners ensure fluidity by adhering external additives, e.g., fine inorganic particles such as silica and alumina, to the surface of the toner. Thus, it has been strongly required to improve the fluidity of the color toner itself.

At present, it has been strongly required to provide colorants for color toner exhibiting excellent fluidity and dispersibility in binder resin. However, such colorants satisfying these properties have not been obtained yet.

When organic pigments are used as the colorants, it has been difficult to readily obtain a color toner having a uniform hue because of poor dispersibility of the organic pigments in resins, and the color toner has failed to show a good fluidity without addition of the external additives.

In Japanese Patent Application Laid-Open (KOKAI) Nos. 58-25643(1983), 60-173553(1985) and 7-90310(1995), it is described that the surface of magnetic particles is coated with white pigments or color pigments. However, since it is difficult to completely hide inherent hue of the magnetic particles as core particles, it is difficult to obtain color toners having a clear hue.

Also, in Japanese Patent Application Laid-Open (KOKAI) Nos. 11-338191(1999), 2001-5222 and 2001-13730, there are described black non-magnetic composite particles comprising black iron oxide particles or black iron oxide hydroxide particles; a coating layer formed on the surface of the black iron oxide particles or black iron oxide hydroxide particles which comprise organosilane compounds obtainable from alkoxysilanes, or polysiloxanes; and a carbon black coat formed on the coating layer comprising the organosilane compounds or polysiloxanes. However, these techniques described in these prior arts aim at fixedly adhering carbon black onto the black inorganic particles. Therefore, the objects and effects of these prior arts are quite different from those of the present invention relating to a colorant for color toner having a clear hue and a high chroma.

As a result of the present inventors', earnest studies, it has been found that by mixing extender pigments with a gluing agent to coat the surface of individual extender pigments with the gluing agent, and then mixing the gluing agent-coated extender pigments with organic pigments, the obtained colorant can exhibit a good fluidity and an excellent dispersibility in binder resin upon production of toner because the organic pigments can be effectively prevented from being desorbed or fallen-off from the surface of the extender pigments, and show a clear hue. The present invention has been attained on the basis of the above finding.

SUMMARY OF THE INVENTION

An object of the present invention is to provide a color toner having a clear hue and an excellent fluidity.

Another object of the present invention is to provide a colorant for color toner capable of exhibiting not only a clear hue, but also an excellent dispersibility in toner because of effectively preventing organic pigments from being desorbed or fallen-off from the surface of respective extender pigments.

To accomplish the aims, in a first aspect of the present invention, there is provided a color toner comprising: a binder resin, and a colorant having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

In a second aspect of the present invention, there is provided a colorant for color toner, having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

In a third aspect of the present invention, there is provided a color toner having an average particle diameter of preferably 3 to 25 μm, a C* value of not less than 20, and a fluidity index of 76 to 100, and comprising: a binder resin, and a colorant having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

In a fourth aspect of the present invention, there is provided an electrostatic developing system for developing an electrostatic latent image using as a developer a color toner composed mainly of a thermoplastic resin and pigments, comprising using a color toner as defined in the first aspect as a developer.

In a fifth aspect of the present invention, there is provided an electrostatic developing system for developing an electrostatic latent image using as a developer a color toner composed mainly of a thermoplastic resin and pigments, comprising using a color toner as defined in the first aspect and a magnetic carrier as a developer.

DETAILED DESCRIPTION OF THE INVENTION

The present invention will now be described in detail below.

First, the colorant for color toner used in the present invention is described.

As the extender pigments used in the present invention, there may be exemplified fine silica particles such as silica powder, white carbon, fine silicate powder and diatomaceous earth, clay, calcium carbonate, precipitated barium sulfate, alumina white, talc, transparent titanium oxide and satin white.

The extender pigments may be those having any suitable shape such as spherical particles, granular particles, polyhedral particles, acicular particles, spindle-shaped particles, rice ball-like particles, flake-shaped particles, scale-like particles and plate-shaped particles.

In the consideration of good fluidity, the obtained colorant for color toner is in the form of spherical particles or granular particles having a sphericity (average particle diameter/average minimum diameter; hereinafter referred to merely as "sphericity") of usually from 1.0 to less than 2.0, preferably 1.0 to 1.8, more preferably 1.0 to 1.5.

As to the particle size of the extender pigments, the average particle diameter thereof is usually 0.005 to 0.30 μm, preferably 0.006 to 0.25 μm, more preferably 0.007 to 0.20 μm.

When the average particle diameter of the extender pigments is more than 0.30 μm, the obtained colorant becomes coarse particles, resulting in poor dispersibility in binder resin. When the average particle diameter of the extender pigments is less than 0.005 μm, such extender pigments tend to be agglomerated by the increase of intermolecular force therebetween due to fine particles of the extender pigments, so that it may be difficult to uniformly coat the surface of the extender pigment with a gluing agent and uniformly adhere the organic pigments onto the gluing agent-coating layer.

The extender pigments have a BET specific surface area value of preferably not less than 20 $m^2/g$. When the BET specific surface area value is less than 20 $m^2/g$, the extender pigments may tend to become coarse particles, or suffer from sintering within and between the particles, so that the obtained colorant may also become coarse particles and may tend to be deteriorated in dispersibility in binder resin. In the consideration of good dispersibility in binder resin, the BET specific surface area value of the extender pigments is more preferably not less than 25 $m^2/g$, still more preferably not less than 30 $m^2/g$. In the consideration of uniform coating of the gluing agent onto the surface of the extender pigments and uniform adhesion of the organic pigments onto the gluing agent-coating layer, the upper limit of the BET specific surface area value of the extender pigments is usually 500 $m^2/g$, preferably 400 $m^2/g$, more preferably 300 $m^2/g$.

The extender pigments have a specific gravity of preferably 1.3 to 4.5, more preferably 1.4 to 4.0, still more preferably 1.5 to 3.0. In particular, when the specific gravity is more than 4.5, the obtained colorant for color toner also may tend to exhibit a too large specific gravity.

As to the fluidity of the extender pigments, the fluidity index thereof is preferably not less than 40, more preferably 43 to 80, still more preferably 46 to 80. When the fluidity index is less than 40, the obtained extender pigments may fail to show a good fluidity, so that it may be difficult to obtain a colorant for color toner having an excellent fluidity.

As to the hue of the extender pigments, the C* value thereof is preferably not more than 16.0, more preferably not more than 14.0, still more preferably not more than 12.0. When the C* value of the extender pigments is more than 16.0, it may be difficult to obtain a colorant having the aimed clear hue because the extender pigments as core particles of the colorant show a too strong hue.

The extender pigments of the present invention have a hiding power of preferably less than 300 $m^2/g$, more preferably not more than 200 $m^2/g$, still more preferably not more than 100 $m^2/g$.

The gluing agent used in the present invention may be of any kind as long as the organic pigment can be adhered onto the surface of the extender pigment therethrough. Examples of the preferred gluing agents may include organosilicon compounds such as alkoxysilanes, fluoroalkylsilanes and polysiloxanes; various coupling agents such as silane-based coupling agents, titanate-based coupling agents, aluminate-based coupling agents and zirconate-based coupling agents; oligomer compounds, polymer compounds or the like. These gluing agents may be used alone or in the form of a mixture of any two or more thereof. In the consideration of adhesion strength of the organic pigment onto the surface of the extender pigments through the gluing agent, the more preferred gluing agents are the organosilicon compounds such as alkoxysilanes, fluoroalkylsilanes and polysiloxanes, and various coupling agents such as silane-based coupling agents, titanate-based coupling agents, aluminate-based coupling agents and zirconate-based coupling agents. Still more preferred gluing agents are the organosilicon compounds such as alkoxysilanes, fluoroalkylsilanes and polysiloxanes, and most preferred gluing agents are alkoxysilanes and polysiloxanes.

As organosilicon compounds used in the present invention, at least one organosilicon compound selected from the group consisting of (1) organosilane compounds obtained from alkoxysilane compounds; (2) polysiloxanes, or modified polysiloxanes selected from the group consisting of (2-A) polysiloxanes modified with at least one compound selected from the group consisting of polyethers, polyesters and epoxy compounds (hereinafter referred to merely as "modified polysiloxanes"), and (2-B) polysiloxanes whose molecular terminal is modified with at least one group selected from the group consisting of carboxylic acid groups, alcohol groups and a hydroxyl group; and (3) fluoroalkyl organosilane compounds obtained from fluoroalkylsilane compounds.

The organosilane compounds (1) can be produced from alkoxysilane compounds represented by the formula (I):

$$R^1_aSiX_{4-a} \quad (I)$$

wherein $R^1$ is $C_6H_5$—, $(CH_3)_2$—$CHCH_2$— or n—$C_bH_{2b+1}$— (wherein b is an integer of 1 to 18); X is $CH_3O$— or $C_2H_5O$—; and a is an integer of 0 to 3.

Specific examples of the alkoxysilane compounds may include methyltriethoxysilane, dimethyldiethoxysilane, phenyltriethyoxysilane, diphenyldiethoxysilane, dimethyldimethoxysilane, methyltrimethoxysilane, phenyltrimethoxysilane, diphenyldimethoxysilane, isobutyltrimethoxysilane, decyltrimethoxysilane or the like. Among these alkoxysilane compounds, in view of the adhering effect of the organic pigments, methyltriethoxysilane, methyltrimethoxysilane, dimethyldimethoxysilane, isobutyltrimethoxysilane and phenyltriethyoxysilane are preferred, and methyltriethoxysilane, methyltrimethoxysilane, dimethyldimethoxysilane and phenyltriethyoxysilane are more preferred.

As the polysiloxanes (2), there may be used those compounds represented by the formula (II):

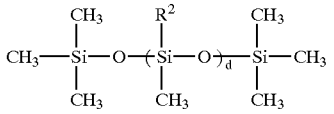

(II)

wherein $R^2$ is H— or $CH_3$—, and d is an integer of 15 to 450.

Among these polysiloxanes, in view of the adhering effect of the organic pigment, polysiloxanes having methyl hydrogen siloxane units are preferred.

As the modified polysiloxanes (2-A), there may be used:

(a1) polysiloxanes modified with polyethers represented by the formula (III):

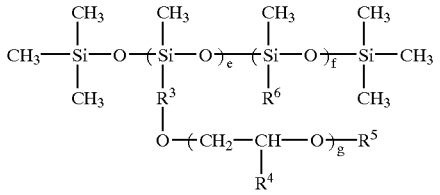

(III)

wherein $R^3$ is —(—$CH_2$—)$_h$—; $R^4$ is —(—$CH_2$—)$_i$—$CH_3$; $R^5$ is —OH, —COOH, —CH=$CH_2$, —CH($CH_3$)=$CH_2$ or —(—$CH_2$—)$_j$—$CH_3$; $R^6$ is —(—$CH_2$—)$_k$—$CH_3$; g and h are an integer of 1 to 15; i, j and k are an integer of 0 to 15; e is an integer of 1 to 50; and f is an integer of 1 to 300;

(a2) polysiloxanes modified with polyesters represented by the formula (IV):

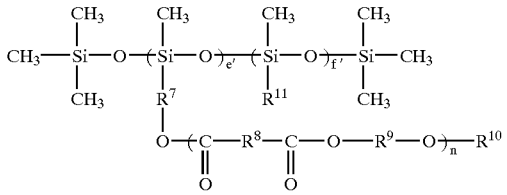

(IV)

wherein $R^7$, $R^8$ and $R^9$ are —(—$CH_2$—)$_q$— and may be the same or different; $R^{10}$ is —OH, —COOH, —CH=$CH_2$, —CH($CH_3$)=$CH_2$ or —(—$CH_2$—)$_r$—$CH_3$; $R^{11}$ is —(—$CH_2$—)$_s$—$CH_3$; n and q are an integer of 1 to 15; r and s are an integer of 0 to 15; e' is an integer of 1 to 50; and f' is an integer of 1 to 300;

(a3) polysiloxanes modified with epoxy compounds represented by the formula (V):

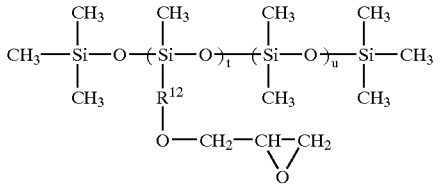

(V)

wherein $R^{12}$ is —(—$CH_2$—)$_v$—; v is an integer of 1 to 15; t is an integer of 1 to 50; and u is an integer of 1 to 300; or a mixture thereof.

Among these modified polysiloxanes (2-A), in view of the adhering effect of the organic pigment, the polysiloxanes modified with the polyethers represented by the formula (III), are preferred.

As the terminal-modified polysiloxanes (2-B), there may be used those represented by the formula (VI):

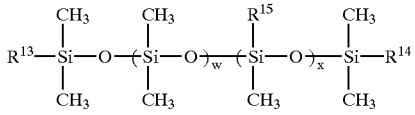

(VI)

wherein $R^{13}$ and $R^{14}$ are —OH, $R^{16}$OH or $R^{17}$COOH and may be the same or different; $R^{15}$ is —$CH_3$ or —$C_6H_5$; $R^{16}$ and $R^{17}$ are —(—$CH_2$—)$_y$—; wherein y is an integer of 1 to 15; w is an integer of 1 to 200; and x is an integer of 0 to 100.

Among these terminal-modified polysiloxanes, in view of the adhering effect of the organic pigment, the polysiloxanes whose terminals are modified with carboxylic acid groups are preferred.

The fluoroalkyl organosilane compounds (3) may be produced from fluoroalkylsilane compounds represented by the formula (VII):

$$CF_3(CF_2)_zCH_2CH_2(R^{18})_{a'}SiX_{4-a'} \quad \text{(VII)}$$

wherein $R^{18}$ is $CH_3$—, $C_2H_5$—, $CH_3O$— or $C_2H_5O$—; X is $CH_3O$— or $C_2H_5O$—; and z is an integer of 0 to 15; and a' is an integer of 0 to 3.

Specific examples of the fluoroalkylsilane compounds may include trifluoropropyl trimethoxysilane, tridecafluorooctyl trimethoxysilane, heptadecafluorodecyl trimethoxysilane, heptadecafluorodecylmethyl dimethoxysilane, trifluoropropyl triethoxysilane, tridecafluorooctyl triethoxysilane, heptadecafluorodecyl triethoxysilane, or the like. Among these fluoroalkylsilane compounds, in view of the adhering effect of the organic pigment, trifluoropropyl trimethoxysilane, tridecafluorooctyl trimethoxysilane and heptadecafluorodecyl trimethoxysilane are preferred, and trifluoropropyl trimethoxysilane and tridecafluorooctyl trimethoxysilane are more preferred.

As the silane-based coupling agents, there may be exemplified vinyltrimethoxysilane, vinyltriethoxysilane, γ-aminopropyltriethoxysilane, γ-glycidoxypropyltrimethoxysilane, γ-mercaptopropyltrimethoxysilane, γ-methacryloxypropyltrimethoxysilane, N-b (aminoethyl)-γ-aminopropyltrimethoxysilane, γ-glycidoxypropylmethyldimethoxysilane, γ-chloropropyltrimethoxysilane or the like.

As the titanate-based coupling agents, there may be exemplified isopropyltristearoyl titanate, isopropyltris (dioctylpyrophosphate)titanate, isopropyltri(N-aminoethyl-aminoethyl)titanate, tetraoctylbis(ditridecylphosphate) titanate, tetra(2,2-diaryloxymethyl-1-butyl)bis(ditridecyl) phosphate titanate, bis(dioctylpyrophosphate)oxyacetate titanate, bis(dioctylpyrophosphate)ethylene titanate or the like.

As the aluminate-based coupling agents, there may be exemplified acetoalkoxyaluminum diisopropilate, aluminumdiisopropoxymonoethylacetoacetate, aluminumtrisethylacetoacetate, aluminumtrisacetylacetonate or the like.

As the zirconate-based coupling agents, there may be exemplified zirconiumtetrakisacetylacetonate, zirconiumdibutoxybisacetylacetonate, zirconiumtetrakisethylacetoacetate, zirconiumtributoxymonoethylacetoacetate, zirconiumtributoxyacetylacetonate or the like.

It is preferred to use oligomer compounds having a molecular weight of from 300 to less than 10,000. It is preferred to use polymer compounds having a molecular weight of 10,000 to about 100,000. In the consideration of forming a uniform coating layer on the extender pigments, the oligomers or polymer compounds are preferably in a liquid state, or soluble in water or various solvents.

The amount of the gluing agent-coating layer is preferably 0.01 to 15.0% by weight, more preferably 0.02 to 12.5% by weight, still more preferably 0.03 to 10.0% by weight (calculated as C) based on the weight of the gluing agent-coated extender pigments.

When the amount of the gluing agent-coating layer is less than 0.01% by weight, it may be difficult to adhere not less than one part by weight of the organic pigment onto 100 parts by weight of the extender pigments. When the amount of the gluing agent-coating layer is more than 15.0% by weight, since it is possible to adhere 1 to 500 parts by weight of the organic pigment onto 100 parts by weight of the extender pigments therethrough, it is unnecessary to form the gluing agent-coating layer in an amount of more than 15.0% by weight.

As the organic pigments of the present invention, there may be used various organic pigments showing yellow, magenta and cyan colors required for color toner, such as yellow-based organic pigments, red-based organic pigments and blue-based organic pigments. These organic pigments may be used, if required, in the form of a mixture of any two or more thereof. Further, the respective organic pigments may contain other organic pigments having different hues in order to improve spectral characteristics of the colorant for color toner.

Examples of the organic yellow-based pigments may include monoazo-based pigments such as Hanza yellow, disazo-based pigments such as benzidine yellow and permanent yellow, condensed azo pigments such as condensed azo yellow, isoindolin-based pigments such as isoindolin yellow, or the like. Examples of the organic red-based pigments may include quinacridon pigments such as quinacridon red, azo-based pigments such as permanent red, condensed azo pigments such as condensed azo red, vat color pigments such as dianthraquinonyl red, perylene pigment such as perylene red, or the like. Examples of the organic blue-based pigments may include phthalocyanine-based pigments such as metal-free phthalocyanine blue, phthalocyanine blue, fast sky blue, alkali blue, or the like.

The amount of the organic pigments adhered is usually 1 to 500 parts by weight, preferably 5 to 400 parts by weight, more preferably 10 to 300 parts by weight based on 100 parts by weight of the extender pigments.

When the amount of the organic pigments adhered is less than 1 part by weight or more than 500 parts by weight, it may be difficult to attain the aimed effects of the present invention.

The particle shape and particle size of the colorant for color toner according to the present invention largely depend upon those of the extender pigments as core particles, and has a similar particle configuration as that of the core particles.

More specifically, the colorant for color toner according to the present invention has an average particle diameter of usually 0.005 to 0.30 μm, preferably 0.006 to 0.25 μm, more preferably 0.007 to 0.20 μm.

When the average particle diameter of the colorant is more than 0.30 μm, the obtained colorant tends to be deteriorated in dispersibility in binder resin because of too large particle diameter thereof. When the average particle diameter of the colorant is less than 0.005 μm, the colorant tends to be agglomerated by the increase of intermolecular force therebetween due to fine particles, resulting in poor dispersibility in binder resin.

The colorant for color toner according to the present invention has a BET specific surface area value of preferably 30 to 500 $m^2/g$, more preferably 35 to 400 $m^2/g$, still more preferably 40 to 300 $m^2/g$. When the BET specific surface area value of the colorant is less than 30 $m^2/g$, the obtained colorant may be in the form of coarse particles, or tends to be deteriorated in sintering within and between the particles, resulting in poor dispersibility in binder resin. When the BET specific surface area value of the colorant is more than 500 $m^2/g$, the colorant tends to be agglomerated together by the increase of intermolecular force therebetween due to fine particles, resulting in poor dispersibility in binder resin.

As to the hue of the colorant for color toner according to the present invention, the C* value thereof is preferably not less than 20, more preferably not less than 22, still more preferably not less than 24. When the C* value of the colorant is less than 20, the obtained colorant may fail to show a clear hue.

The colorant for color toner according to the present invention has a specific gravity of preferably 1.3 to 3.5, more preferably 1.4 to 3.0, still more preferably 1.5 to 2.5. In the case where the amount of the colorant blended in binder resin is kept constant, when the specific gravity of the colorant is more than 3.0, the volume of the colorant per unit volume of the toner becomes too small, thereby failing to exhibit a sufficient tinting strength. As a result, it may be difficult to obtain a color toner having a clear hue.

As to the fluidity of the colorant for color toner according to the present invention, the fluidity index thereof is preferably not less than 45, more preferably not less than 50, still more preferably 55 to 90. When the fluidity index of the colorant is less than 45, the obtained colorant may fail to show an excellent fluidity, so that it may be difficult to further improve the fluidity of a color toner obtained from the colorant.

The colorant for color toner according to the present invention has a desorption percentage of organic pigments of preferably not more than 10%, more preferably not more than 8%. When the desorption percentage of organic pigments from the colorant is more than 10%, the colorant may be inhibited from being uniformly dispersed in the binder resin because of a large amount of the desorbed organic pigments.

The tinting strength of the colorant for color toner according to the present invention is preferably not less than 115%, more preferably not less than 120% as evaluated by the below-mentioned method.

Next, the color toner containing the colorant of the present invention is described.

The color toner of the present invention comprises the colorant for color toner according to the present invention, and a binder resin, and may further contain, if required, a mold-releasing agent, a charge controller and other additives.

The color toner of the present invention has an average particle diameter of preferably 3 to 25 $\mu$m, more preferably 4 to 18 $\mu$m, still more preferably 5 to 15 $\mu$m.

The amount of the colorant contained in the color toner is preferably 1.2 to 20.0% by weight, more preferably 1.8 to 19.0% by weight, still more preferably 2.4 to 18.0% by weight.

As the binder resin, there may be used polyester-based resins; epoxy-based resins; polyolefin-based resins; polyurethane-based resins; vinyl-based polymers obtained by polymerizing or copolymerizing vinyl-based monomers such as styrene, alkyl acrylates and alkyl methacrylates; styrene-butadiene copolymers; or the like. Examples of the styrene monomers may include styrene and substituted styrenes. Examples of the alkyl acrylate monomers may include acrylic acid, methyl acrylate, ethyl acrylate, butyl acrylate or the like. These resins may be used alone or in the form of a mixture of any two or more thereof.

As to the fluidity of the color toner, the fluidity index thereof is usually 76 to 100, preferably 78 to 100, more preferably 80 to 100. When the fluidity index of the color toner is less than 76, the color toner may fail to show an excellent fluidity.

As to the hue of the color toner of the present invention, the C* value thereof is preferably not less than 20, more preferably not less than 22, still more preferably not less than 24. When the C* value of the color toner is less than 20, the color toner may fail to show a clear hue.

Next, the developing method of the present invention is described.

In the developing method used in the present invention, an electrostatic latent image is developed using the color toner of the present invention mainly comprising a thermoplastic resin and pigments.

More specifically, in the non-magnetic one-component developing method used in the present invention, an electrostatic latent image is first formed on the surface of a photosensitive member or an image-retaining member. Then, the color toner is supplied to a non-magnetic sleeve or an elastic rubber, sponge or plastic member disposed opposite to the surface of the photosensitive member or image-retaining member to form a toner layer thereon. The toner layer formed on the non-magnetic sleeve or the elastic rubber, sponge or plastic member is then brought into slide-frictional contact with the photosensitive member or image-retaining member to develop the electrostatic latent image into visual image.

Also, in the two-component developing method used in the present invention, an electrostatic latent image is first formed on the surface of a photosensitive member or an electrostatic charge-retaining member. Then, a developer obtained by blending the color toner with a magnetic carrier is supplied to a non-magnetic sleeve disposed opposite to the surface of the photosensitive member or electrostatic charge-retaining member and equipped therein with a magnetic field-generating member. The magnetic brush formed on the non-magnetic sleeve is then brought into slide-frictional contact with the photosensitive member or electrostatic charge-retaining member to develop the electrostatic latent image into visual image.

As the magnetic carrier used in the two-component developing method, there may be used known magnetic carriers. Specific examples of the magnetic carriers may include iron oxide-based carriers containing magnetite or soft ferrite (such as Ni—Zn-based ferrite, Mg—Zn-based ferrite, Cu—Zn-based ferrite, Ba-Ni-Zn-based ferrite or the like); composite carriers containing an iron powder carrier, a resin and magnetic particles; or the like.

The magnetic carrier has an average particle diameter of usually 10 to 200 $\mu$m, preferably 20 to 150 $\mu$m.

In the case where the color toner of the present invention is used in the above developing methods, it is possible to not only prevent occurrence of fogging on a background portion, but also obtain images having a high density and an excellent durability.

The image density is preferably not less than 1.10, more preferably not less than 1.20.

As to the image durability, the charge rate of the image density is preferably not more than 10%, more preferably not more than 8%, still more preferably not more than 6%.

As to the image fogging, the DL* value is preferably not more than 4.0, more preferably not more than 3.0 as measured by the below-mentioned method.

Next, the process for producing the colorant for the color toner according to the present invention is described.

The colorant for the color toner of the present invention can be produced by first mixing the extender pigments with the gluing agent to coat the surface of the extender pigment with the gluing agent, and then mixing the thus-obtained gluing agent-coated extender pigments with the organic pigment.

The formation of the gluing agent-coating layer on the surface of the extender pigment or each colored adhesion layer may be conducted by mechanically mixing and stirring the extender pigments with a gluing agent solution or the gluing agent, or by mechanically mixing and stirring the extender pigments while spraying the gluing agent solution or the gluing agent thereonto. Substantially whole amount of the gluing agent added is adhered on the surface of the extender pigment.

Meanwhile, in the case where alkoxysilanes or fluoroalkylsilanes are used as the gluing agent, a part of the alkoxysilanes or fluoroalkylsilanes may be coated in the form of organosilane compounds produced from the alkoxysilanes or fluoroalkyl organosilane compounds obtainable form fluoroalkylsilanes through the coating step. Even in such a case, subsequent adhesion of the organic pigment on the gluing agent-coating layer is not adversely affected.

In order to uniformly adhere the gluing agent over the surface of the extender pigment, it is preferred that the agglomerated extender pigments are previously deaggregated using a crusher.

The mixing and stirring of the extender pigments with the gluing agent and the mixing and stirring of the organic pigment with the gluing agent-coated extender pigments, is preferably carried out using an apparatus capable of applying a shear force to the powder mixture, especially such an apparatus capable of simultaneously effecting shear action, spatula stroking and compression. Examples of such apparatuses may include wheel-type kneaders, ball-type kneaders, blade-type kneaders, roll-type kneaders or the like. Among these apparatuses, the wheel-type kneaders are preferred to effectively practice the present invention.

Specific examples of the wheel-type kneaders may include edge runners (similar in meaning to mix muller, Simpson mill and sand mill), multimill, Stotz mill, Wet pan mill, corner mill, ring muller or the like. Among these kneaders, preferred are edge runners, multimill, Stotz mill, Wet pan mill and ring muller, and more preferred are edge runners. Specific examples of the ball-type kneaders may include vibration mill or the like. Specific examples of the blade-type kneaders may include Henschel mixer, planetary mixer, Nauter mixer or the like. Specific examples of the roll-type kneaders may include extruders or the like.

The conditions of the mixing and stirring treatment may be selected so as to uniformly coat the surface of the extender pigment with the gluing agent. Specifically, the mixing and stirring conditions may be appropriately controlled such that the linear load is usually 19.6 to 1,960 N/cm (2 to 200 Kg/cm), preferably 98 to 1,470 N/cm (10 to 150 Kg/cm), more preferably 147 to 980 N/cm (15 to 100 Kg/cm); the treating time is usually 5 minutes to 24 hours, preferably 10 minutes to 20 hours; and the stirring speed is usually 2 to 2,000 rpm, preferably 5 to 1,000 rpm, more preferably 10 to 800 rpm.

The amount of the gluing agent added is preferably 0.15 to 45 parts by weight based on 100 parts by weight of the extender pigments. When the gluing agent is added in an amount of 0.15 to 45 parts by weight, it is possible to adhere 1 to 500 parts by weight of the organic pigment onto 100 parts by weight of the extender pigments.

After the surface of the extender pigment is coated with the gluing agent, the organic pigment is added, and then mixed and stirred with the coated extender pigments to adhere the organic pigment onto the gluing agent-coating layer. The obtained particles may be further subjected to drying or heating treatments, if required.

It is preferred that the organic pigments are gradually added little by little for a period of preferably about 5 minutes to about 24 hours, more preferably about 5 minutes to about 20 hours, or are intermittently added in parts until the total amount thereof reaches 5 to 25 parts by weight based on 100 parts by weight of the extender pigments.

The mixing and stirring conditions may be appropriately selected so as to form a uniform organic pigment coat on the gluing agent-coating layer, and may be controlled such that the linear load is usually 19.6 to 1,960 N/cm (2 to 200 Kg/cm), preferably 98 to 1,470 N/cm (10 to 150 Kg/cm), more preferably 147 to 980 N/cm (15 to 100 Kg/cm); the treating time is usually 5 minutes to 24 hours, preferably 10 minutes to 20 hours; and the stirring speed is usually 2 to 2,000 rpm, preferably 5 to 1,000 rpm, more preferably 10 to 800 rpm.

The amount of the organic pigments added is usually 1 to 500 parts by weight, preferably 5 to 400 parts by weight, more preferably 10 to 300 parts by weight based on 100 parts by weight of the extender pigments. When the amount of the organic pigments added is out of the above-specified range, it may be difficult to obtain the aimed colorant.

The heating temperature used upon the drying and heating treatments is usually 40 to 150° C., preferably 60 to 120° C. The heating time is usually from 10 minutes to 12 hours, preferably from 30 minutes to 3 hours.

Meanwhile, when alkoxysilanes or fluoroalkylsilanes are used as the gluing agent, a coating layer comprising organosilane compounds obtainable from the alkoxysilanes or fluorine-containing organosilane compounds obtainable from the fluoroalkylsilanes is finally formed on the respective extender pigments via these treatment steps.

Next, the process for producing the color toner according to the present invention is described.

The color toner of the present invention can be produced by an ordinary method, i.e., by blending a predetermined amount of the binder resin and a predetermined amount of the colorant with each other, and then subjecting the resultant mixture to kneading and pulverization. More specifically, the colorant and the binder resin are charged, if required, together with a mold-releasing agent, a charge controller and other additives into a mixing apparatus, and intimately mixed together therein. The resultant mixture was kneaded by a heating kneader to disperse the colorant in the binder resin, and then cooled and solidified, thereby obtaining a kneaded resin material. Then, the kneaded resin material is pulverized and classified to obtain particles having the aimed particle size.

As the mixing apparatus, there may be used a Henschel mixer, a ball mill or the like. As the heating kneader, there may be used a roll mill, a kneader, a twin-screw extruder or the like. Also, the pulverization may be conducted using any suitable pulverizer such as a cutter mill and a jet mill. The classification may be conducted by a known method such as air classification as described in Japanese Patent No. 2,683,142, etc.

The color toner may also be produced by other methods such as a suspension polymerization method and an emulsion polymerization method. In the suspension polymerization method, the polymerizable monomer and the colorant are mixed, if required, together with a polymerization initiator, a cross-linking agent, a charge controller and other additives, and the resultant mixture is dissolved and dispersed to obtain a monomer composition. The thus obtained monomer composition is then added to a water phase containing a suspension stabilizer while stirring, granulated and then polymerized, thereby obtaining a color toner having the aimed particle size.

Also, in the emulsion polymerization method, the monomer and the colorant are dispersed in water, if required, together with a polymerization initiator or the like, and then polymerized by adding an emulsifier thereto, thereby obtaining a color toner having the aimed particle size.

The point of the present invention is that the color toner containing the colorant comprising the extender pigments, the gluing agent-coating layer formed on the surface of the extender pigment, and the organic pigment coat formed on the gluing agent-coating layer, can exhibit not only a clear hue, but also excellent fluidity and dispersibility of the colorant in toner.

The reason why the colorant contained in the color toner of the present invention can exhibit an excellent dispersibility in toner, is considered as follows. That is, in the case of the colorant of the present invention, since the organic pigments usually acting as agglomerates in toner are fixedly bonded onto the surface of the core particles through the gluing agent-coating layer, the amount of the organic pigments desorbed from the surface of the extender pigment is very small. As a result, the colorant can be well dispersed in the binder resin without disturbance by the desorbed organic pigments. In addition, since the compatibility between the colorant and the binder resin is enhanced by forming the gluing agent-coating layer on the surface of the extender pigment and further forming the organic pigment coat onto the gluing agent-coating layer, the colorant can be further improved in dispersibility in the binder resin.

The reason why the color toner of the present invention can exhibit a clear hue, is considered as follows. That is, in the case of the colorant contained in the color toner of the present invention, since the extender pigment of the colorant are selected from the extender pigments having a low chroma and a low hiding power, the organic pigments adhered thereon can exhibit an inherent clear hue without being vanished by the hue of the extender pigments. In addition, since the colorant shows an excellent dispersibility in toner, the colorant can also exhibit its clear hue without agglomeration unlike organic pigments.

Further, the reason why the color toner of the present invention can exhibit an excellent fluidity, is considered as follow. That is, in the case of the colorant contained in the color toner of the present invention, since the extender pigments of the colorant have an excellent fluidity such as fine silica particles which are usually used as external additives for improving the fluidity of toners, the colorant can exhibit an excellent fluidity. In addition, since the colorant is uniformly dispersed inside and outside the binder resin, adequate irregularities are formed on the respective toner particles, so that the obtained color toner can be enhanced in fluidity.

The color toner of the present invention is produced using the colorant having not only a clear hue but also an excellent fluidity and, therefore, can also exhibit a clear hue and an excellent fluidity.

EXAMPLES

The present invention is described in more detail by Examples and Comparative Examples, but the Examples are only illustrative and, therefore, not intended to limit the scope of the present invention thereto.

Various properties were measured by the following methods.

(1) The average particle diameter of the particles was expressed by the average value of measured particle diameters of 350 particles observed on an electron micrograph (×50,000).

(2) The sphericity of the particles was expressed by the ratio of the average particle diameter (average maximum diameter) to the average minimum diameter.

(3) The specific surface area was expressed by the value measured by a BET method.

(4) The specific gravity of the particles was measured using a "Multi-Volume Densitometer 1305-Model" manufactured by Micro-Meritix Co., Ltd.

(5) The amounts of the cluing agent-coating layer formed on the surface of the extender pigments, and the organic pigment coat formed on the gluing agent-coating layer were respectively determined by measuring the carbon contents using "Horiba Metal, Carbon and Sulfur Analyzer EMIA-2200 Model" (manufactured by HORIBA SEISAKUSHO CO., LTD.).

(6) The desorption percentage (%) of the organic pigment desorbed from the extender pigments was measured by the following method. The closer to 0% the desorption percentage, the smaller the amount of the organic pigment desorbed from the surface of the extender pigment.

That is, 2 g of the particles to be measured and 20 ml of dibromomethane were placed in a 50-ml conical flask and then were subjected to ultrasonic dispersion for 20 minutes. Thereafter, the obtained dispersion was allowed to stand for 3 days, and a supernatant containing the organic pigment desorbed was separated from the particles on the basis of the difference in specific gravity between the organic pigment and the particles. Next, the light transmittance of the obtained supernatant was measured by a self-recording photoelectric spectrophotometer "UV-2100" (manufactured by SHIMADZU SEISAKUSHO CO., LTD.). Using a calibration curve prepared on the basis of a concentration of organic pigment contained in dibromomethane and its light transmittance as previously calculated, the concentration of the desorbed organic pigment present in dibromomethane was calculated from the measured value, and further the desorption percentage (%) of the organic pigment was calculated according to the following formula:

Desorption percentage of $$\text{organic pigment } (\%)=\{(W_a-W_e)/W_a\}\times 100$$

wherein $W_a$ represents an amount of organic pigment initially adhered onto the surface of the extender pigment; and We represents an amount of organic pigment still adhered on the surface of the extender pigment after desorption test.

(7) The hue of each of the extender pigments, organic pigment and colorant, were measured by the following method.

That is, 0.5 g of each sample and 0.5 ml of castor oil were intimately kneaded together by a Hoover's muller to form a paste. 4.5 g of clear lacquer was added to the obtained paste and was intimately kneaded to form a paint. The obtained paint was applied on a cast-coated paper by using a 150 $\mu$m (6-mil) applicator to produce a coating film piece (having a film thickness of about 30 $\mu$m). The thus obtained coating film piece was measured by a multi-spectro-colour-meter "MSC-IS-2D" (manufactured by SUGA TESTING MACHINES MANUFACTURING CO., LTD.) to determine L*, a* and b* values thereof, respectively. Meanwhile, the C* value representing chroma is calculated according to the following formula:

$$C^*=((a^*)^2+(b^*)^2)^{1/2}$$

(8) The tinting strength of the colorant was measured by the following method.

That is, a primary color enamel and a vehicle enamel prepared by the below-mentioned method were respectively applied on a cast-coated paper by a 150 $\mu$m (6-mil) applicator to produce coating film pieces. The thus obtained coating film pieces were measured by a multi-spectro-colour-meter "MSC-IS-2D" (manufactured by SUGA TESTING MACHINES MANUFACTURING CO., LTD.) to determine L* values thereof. The difference between the obtained L* values was represented by a DL* value.

Next, as a standard sample for the colorant, a mixed pigment was prepared by simply mixing the organic pigment and the extender pigments at the same mixing ratio as used for the production of the colorant. Using the thus prepared mixed pigment as standard sample, the same procedure as defined above was conducted to prepare an primary color enamel and a vehicle enamel, form coating film pieces and measure L* values thereof. The difference between the L* values was represented by a DLs* value.

From the obtained DL* value of the colorant and DLs* value of the standard sample, the tinting strength (%) was calculated according to the following formula:

$$\text{Tinting strength } (\%)=100+\{(DLs^*-DL^*)\times 10\}$$

Preparation of Primary Color Enamel 10 g of the above sample particles, 16 g of an amino alkyd resin and 6 g of a thinner were blended together. The resultant mixture was added together with 90 g of 3mmϕ glass beads into a 140-ml glass bottle, and then mixed and dispersed for 45 minutes by a paint shaker. The obtained mixture was mixed with 50 g of an amino alkyd resin, and further dispersed for 5 minutes by a paint shaker, thereby obtaining an primary color enamel.

Preparation of Vehicle Enamel 12 g of the above-prepared primary color enamel and 40 g of Aramic White (titanium dioxide-dispersed amino alkyd resin) were blended together, and the resultant mixture was mixed and dispersed for 15 minutes by a paint shaker, thereby preparing a vehicle enamel.

(9) The hiding powers of the extender pigments, organic pigment and colorant were measured by the cryptometer method according to JIS K5101-8.2 using the above-prepared primary color enamel.

(10) The fluidity of each of the extender pigments, the colorant and the color toner was expressed by the fluidity index as a sum of indices obtained by measuring respective particle characteristics, i.e., an angle of repose (°), a compaction degree (%), a spatula angle (°) and an agglomeration degree of the particles, and replacing the measured values with numerals based on the same standard. The closer to 100 the fluidity index, the more excellent the fluidity.

(11) The dispersibility of the colorant in binder resin was evaluated by counting the number of undispersed aggregate particles observed on a micrograph (×200) of a section of the color toner particles which was obtained using an optical microscope "BH-2" manufactured by Olympus Kogaku Kogyo Co., Ltd., and classifying the results into the following five ranks. The rank 5 represents the most excellent dispersing condition.

Rank 5: No undispersed aggregate particles were recognized.

Rank 4: 1 to 4 undispersed aggregate particles per 0.25 $mm^2$ were recognized;

Rank 3: 5 to 9 undispersed aggregate particles per 0.25 $mm^2$ were recognized;

Rank 2: 10 to 49 undispersed aggregate particles per 0.25 $mm^2$ were recognized;

Rank 1: Not less than 50 undispersed aggregate particles per 0.25 $mm^2$ were recognized.

(12) The average particle diameter of the color toner was measured by a laser diffraction-type particle size distribution measuring device "Model HELOSLA/KA" manufactured by SYMPATEC Co., Ltd.

(13) The image density was expressed by the average value of image densities measured at five points of the image printed out on a CLC paper of A4 size (80 $g/m^2$; produced by Canon Co., Ltd.) using a Macbeth reflection densitometer (produced by Macbeth Co., Ltd.).

(14) The image durability was expressed by the value obtained by measuring image densities at five points of the image printed out on a CLC paper of A4 size (80 $g/m^2$; produced by Canon Co., Ltd.) as the 5,000th print-out using a Macbeth reflection densitometer (produced by Macbeth Co., Ltd.), calculating respective average values of the measured image densities, and substituting the thus calculated average values for Ca and Ce of the following formula:

$$\text{Image Durability } (\%)=\{(Ca-Ce)/Ca\}\times 100$$

wherein Ca represents the average value of initial image densities; and Ce represents the average value of image densities obtained on the 5,000th print-out.

(15) The image fogging was determined as follows. That is, after repeatedly printing out the image on 5,000 CLC papers of A4 size (80 $g/m^2$; produced by Canon Co., Ltd.), the whiteness L* value of the white image formed on the 5,000th paper using the respective color toner was measured by a multi-spectro-colour-meter "MSC-IS-2D" (manufactured by SUGA TESTING MACHINES MANUFACTURING CO., LTD.), thereby determining the fogging on the paper. In the measurement, an amberlite filter, a blue filter and a green filter were used for color toners containing blue-based organic pigments, yellow-based organic pigments and red-based organic pigments, respectively. The image fogging was expressed by the DL* value obtained by subtracting the whiteness (L* value) of a non-image-forming portion of the 5,000th print-out from the whiteness (L* value). of a non-printed paper. The smaller the DL* value, the less the image fogging.

Example 1

Production of Colorant A 440 g of methyl hydrogen polysiloxane (tradename: "TSF484", produced by GE TOSHIBA SILICONE CO., LTD.) was added to 11 kg of silica particles (particle shape: spherical shape; average particle diameter: 0.022 μm; sphericity: 1.06; BET specific surface area value: 193.8 $m^2/g$; specific gravity: 2.32; fluidity index: 55; L* value: 92.4; a* value: 0.2; b* value: 0.4; C* value: 0.4; hiding power: 10 $cm^2/g$) while operating an edge runner, and the resultant mixture was mixed and stirred for 40 minutes under a linear load of 538 N/cm (60 Kg/cm) at a stirring speed of 22 rpm.

Then, 5.5 kg of organic pigments A (kind: Pigment Blue (phthalocyanine-based pigments); particle shape: granular shape; average particle diameter: 0.06 μm; BET specific surface area value: 71.6 $m^2/g$; specific gravity: 1.65; L* value: 17.7; a* value: 9.7; b* value: −23.4; C* value: 25.4) were added to the mixture for 20 minutes while operating the edge runner, and the resultant mixture was mixed and stirred for 60 minutes under a linear load of 588 N/cm (60 Kg/cm) at a stirring speed of 22 rpm, thereby adhering the organic pigments A onto the methyl hydrogen polysiloxane coating layer formed on the respective silica particles. The obtained particles were dried at 80° C. for 60 minutes using a dryer, thereby obtaining a colorant A.

The thus obtained colorant A was in the form of spherical particles having an average particle diameter of 0.023 μm and a sphericity of 1.07, and had a BET specific surface area value of 176.4 $m^2/g$; a specific gravity of 2.10; and a fluidity index of 70. As to the hue of the colorant A, the L* value thereof was 48.9; the a* value thereof was 10.4; the b* value thereof was −21.6; and the C* value thereof was 24.0. In addition, it was confirmed that the colorant A had a tinting strength of 131%; an desorption percentage of organic pigments of 5.4%; and a coating amount of methyl hydrogen polysiloxane of 1.11% by weight (calculated as C), and that the amount of the organic pigments A adhered was 22.01% by weight (calculated as C; corresponding to 50 parts by weight based on 100 parts by weight of the silica particles). As a result of observing the micrograph, since almost no organic pigments A were recognized from the micrograph, it was confirmed that a substantially whole amount of the organic pigments A used contributed to the formation of the organic pigment coat on the coating layer composed of methyl hydrogen polysiloxane.

Example 2

Production of Colorant B 5.5 kg of organic pigments B (kind: Pigment Red (azo-based pigments); particle shape: granular shape; average major axis diameter: 0.55 μm; BET specific surface area value: 18.6 $m^2/g$; specific gravity: 1.48; L* value: 39.3; a* value: 49.2; b* value: 19.8) were added to 11.0 kg of the silica particles coated with methyl hydrogen polysiloxane as obtained in Example 1, for 20 minutes while operating an edge runner, and the resultant mixture was mixed and stirred for 60 minutes under a linear load of 588 N/cm (60 Kg/cm) at a stirring speed of 22 rpm, thereby adhering the organic pigments B onto the methyl hydrogen polysiloxane coating layer formed on the respective silica particles. The obtained particles were dried at 80° C. for 60 minutes using a dryer, thereby obtaining a colorant B.

The thus obtained colorant B was in the form of spherical particles having an average particle diameter of 0.023 μm and a sphericity of 1.07, and had a BET specific surface area value of 135.9 $m^2/g$; a specific gravity of 2.02; and a fluidity index of 71. As to the hue of the colorant B, the L* value thereof was 47.5; the a* value thereof was 47.7; the b* value thereof was 17.0; and the C* value thereof was 50.6. In addition, it was confirmed that the colorant B had a tinting strength of 130%; a desorption percentage of organic pigments of 5.5%; and a coating amount of methyl hydrogen polysiloxane of 1.10% by weight (calculated as C), and that the amount of the organic pigments B adhered was 19.33% by weight (calculated as C; corresponding to 50 parts by weight based on 100 parts by weight of the silica particles). As a result of observing the micrograph, since almost no organic pigments B were recognized from the micrograph, it was confirmed that a substantially whole amount of the organic pigments B used contributed to the formation of the organic pigment coat on the coating layer composed of methyl hydrogen polysiloxane.

Example 3

Production of Colorant C 5.5 kg of organic pigments C (kind: Pigment Yellow (azo-based pigments); particle shape: granular shape; average major axis diameter: 0.73 μm; BET specific surface area value: 10.5 $m^2/g$; L* value: 66.80; a* value: 0.78; b* value: 70.92) were added to 11.0 kg of the silica particles coated with methyl hydrogen polysiloxane as obtained in Example 1, for 20 minutes while operating an edge runner, and then the resultant mixture was mixed and stirred for 60 minutes under a linear load of 588 N/cm (60 Kg/cm) at a stirring speed of 22 rpm, thereby adhering the organic pigments C onto the methyl hydrogen polysiloxane coating layer formed on the respective silica particles. The obtained particles were dried at 80° C. for 60 minutes using a dryer, thereby obtaining a colorant C.

The thus obtained colorant C was in the form of spherical particles having an average particle diameter of 0.023 μm and a sphericity of 1.07, and had a BET specific surface area value of 124.1 $m^2/g$; a specific gravity of 2.15; and a fluidity index of 70. As to the hue of the colorant C, the L* value thereof was 75.8; the a* value thereof was −3.9; the b* value thereof was 57.2; and the C* value thereof was 57.3. In addition, it was confirmed that the colorant C had a tinting strength of 129%; a desorption percentage of organic pigments of 5.8%; and a coating amount of methyl hydrogen polysiloxane of 1.11% by weight (calculated as C), and that the amount of the organic pigments C adhered was 18.79% by weight (calculated as C; corresponding to 50 parts by weight based on 100 parts by weight of the silica particles). As a result of observing the micrograph, since almost no organic pigments C were recognized from the micrograph, it was confirmed that a substantially whole amount of the organic pigments C used contributed to the formation of the organic pigment coat on the coating layer composed of methyl hydrogen polysiloxane.

Example 4

Production of Color Toner 150 g of the colorant A, 765 g of a styrene-butyl acrylate-methyl methacrylate copolymer resin (molecular weight: 130,000; styrene/butyl acrylate/methyl methacrylate=82.0/16.5/1.5), 70 g of a polypropylene wax (molecular weight: 3,000) and 15 g of a charge controller were charged into a Henschel mixer, and mixed and stirred at a vessel temperature of 60° C. for 15 minutes. The obtained mixed particles were melt-kneaded in a continuous-type twin-screw kneader at 140° C. The obtained kneaded material was cooled in air, coarsely pulverized, finely pulverized and then classified, thereby obtaining a color toner.

The thus obtained color toner had an average particle diameter of 9.7 μm; a dispersibility of Rank 5; and a fluidity index of 87. As to the hue of the color toner, the L* value thereof was 50.1; the a* value thereof was 10.9; the b* value thereof was −21.5; and the C* value thereof was 24.1.

Example 5

Color Toner A

The colorant A, a polyester resin, a polypropylene wax and a charge controller were charged at the following mixing ratio into a Henschel mixer, and mixed and stirred at a vessel temperature of 60° C. for 15 minutes. The obtained mixed particles were melt-kneaded in a continuous-type twin-screw kneader at 140° C. The obtained kneaded material was cooled in air, coarsely pulverized, finely pulverized and then classified, thereby obtaining a magnetic color toner.

Composition of Mixed Particles

| | |
|---|---|
| Colorant A | 10.0 parts by weight |
| Polyester resin | 85.0 parts by weight |
| Polypropylene wax | 10.0 parts by weight |
| Charge controller | 1.0 part by weight |

The thus obtained color toner A had an average particle diameter of 10.1 μm; a dispersibility of Rank 5; and a fluidity index of 88. As to the hue of the color toner, the L* value thereof was 50.3; the a* value thereof was 11.3; the b* value thereof was −21.6; and the C* value thereof was 24.4.

Example 6

Color Toner B

The same procedure as defined in Example 5 was conducted except that the colorant A was changed to the colorant B, thereby obtaining a color toner B.

The thus obtained color toner B had an average particle diameter of 10.3 μm; a dispersibility of Rank 5; and a fluidity index of 87. As to the hue of the color toner B, the L* value thereof was 49.0; the a* value thereof was 47.9; the b* value thereof was 16.6; and the C* value thereof was 50.7.

Example 7

Color Toner C

The same procedure as defined in Example 5 was conducted except that the colorant A was changed to the colorant C, thereby obtaining a color toner C.

The thus obtained color toner C had an average particle diameter of 10.3 μm; a dispersibility of Rank 5; and a fluidity index of 86. As to the hue of the color toner C, the L* value thereof was 77.2; the a* value thereof was −3.6; the b* value thereof was 57.6; and the C* value thereof was 50.7.

Example 8

Developing Method 1: Two-component System Developing Method

The above color toners A to C were respectively mixed with a ferrite carrier to prepare developers. The images were formed by the following method using these developers, and evaluated. That is, an electrostatic latent image was formed on a photosensitive member, and the developers were supplied to a non-magnetic sleeve disposed opposite to the photosensitive member and equipped therein with a magnetic field-generating member to form a magnetic brush thereon. The magnetic brush was brought into slide-frictional contact with the photosensitive member to develop the electrostatic latent image.

The image produced using the color toner A had an image density of 1.29; an image durability of 3.6%; and an image fogging (ΔL* value) of 1.64. The image produced using the color toner B had an image density of 1.27; an image durability of 3.7%; and an image fogging (ΔL* value) of 1.67. The image produced using the color toner C had an image density of 1.28; an image durability of 3.6%; and an image fogging (ΔL* value) of 1.68.

Example 9

Developing Method 2: One-component System Developing Method

The above color toners A to C were respectively used as developers, and the images were formed by the following method using these developers, and evaluated. In the image evaluation, a remodeled apparatus of Hitachi Priusu 4220 was used. First, the toner was charged into a hopper of a developing device, and adhered onto an aluminum sleeve. The amount of the toner adhered was regulated by a blade to form a thin layer of the developer on the sleeve. After the developing device was mounted in a printer, the surface potential of the photosensitive member and the bias voltage of the developing device were set to −600 V and −450 V, respectively, thereby adhering the toner onto the electrostatic latent image. The obtained toner image was transferred to a transfer drum, and further transferred onto a paper, thereby obtaining a printed image.

The image produced using the color toner A had an image density of 1.26; an image durability of 4.2%; and an image fogging (ΔL* value) of 2.12. The image produced using the color toner B had an image density of 1.26; an image durability of 4.2%; and an image fogging (ΔL* value) of 2.19. The image produced using the color toner C had an image density of 1.25; an image durability of 4.3%; and an image fogging (ΔL* value) of 2.15.

Core Particles 1 to 3

As core particles 1 to 3, extender pigments having properties shown in Table 1 were prepared.

Organic Pigments A to C

Organic pigments A to C having properties as shown in Table 2 were prepared.

Examples 10 to 24 and Comparative Examples 1 to 7

The same procedure as defined in Example 1 was conducted except that kinds and amounts of additives added in coating step with gluing agent, linear load and treating time for edge runner treatment used in the coating step with gluing agent, kinds and amounts of organic pigments adhered in organic pigment-adhering step, and linear load and treating time for edge runner treatment used in the organic pigment-adhering step, were changed variously, thereby obtaining colorants.

The essential production conditions are shown in Tables 3 and 4, and various properties of the obtained colorants are shown in Tables 5 and 6.

Examples 25 to 33 and Comparative Examples 8 to 11

The same procedure for the production of color toner as defined in Example 4 was conducted except that kinds of colorants were changed variously, thereby obtaining color toners.

The essential production conditions are shown in Tables 7 and 8, and various properties of the obtained color toners are shown in Tables 9 and 10.

Examples 34 to 41 and Comparative Examples 12 to 14

The same procedure for color toner A as defined in Example 5 was conducted except that kinds of colorants were changed variously, thereby obtaining color toners.

The essential production conditions are shown in Tables 7 and 8, and various properties of the obtained color toners are shown in Tables 9 and 10.

Examples 42 and 43 and Comparative Example 15

The same procedure as defined in Example 8 or 9 was conducted except that kinds of developing methods and color toners were changed variously, thereby forming images.

The essential image-forming conditions and various properties of the obtained images are shown in Table 11.

TABLE 1

| Kind of core particles | Properties of core particles | |
|---|---|---|
| | Kind | Shape |
| Core particles 1 | Silica | Spherical |
| Core particles 2 | Silica | Granular |
| Core particles 3 | Precipitated barium sulfate | Granular |

| Kind of core particles | Properties of core particles | | |
|---|---|---|---|
| | Average particle diameter (μm) | Sphericity (−) | BET specific surface area value ($m^2/g$) |
| Core particles 1 | 0.021 | 1.02 | 196.2 |
| Core particles 2 | 0.013 | 1.28 | 256.3 |
| Core particles 3 | 0.059 | 1.22 | 21.3 |

TABLE 1-continued

| Kind of core particles | Properties of core particles: Specific gravity (–) | Fluidity index (–) |
|---|---|---|
| Core particles 1 | 2.19 | 58 |
| Core particles 2 | 2.43 | 53 |
| Core particles 3 | 4.15 | 40 |

| Kind of core particles | Properties of core particles: Hue: L* value (–) | a* value (–) | b* value (–) | C* value (–) | Hiding power ($cm^2/g$) |
|---|---|---|---|---|---|
| Core particles 1 | 93.1 | 0.1 | 0.3 | 0.3 | 6 |
| Core particles 2 | 94.0 | 0.3 | −0.1 | 0.3 | 11 |
| Core particles 3 | 91.6 | 0.3 | 1.1 | 1.1 | 13 |

TABLE 2

| Organic pigments | Properties of organic pigments: Kind | Shape |
|---|---|---|
| Organic pigments A | Pigment Blue (phthalocyanine-based pigments) | Granular |
| Organic pigments B | Pigment Red (azo-based pigments) | Granular |
| Organic pigments C | Pigment Yellow (azo-based pigments) | Granular |

| Organic pigments | Properties of organic pigments: Average particle diameter (μm) | BET specific surface area value ($m^2/g$) | Specific gravity (–) |
|---|---|---|---|
| Organic pigments A | 0.06 | 71.6 | 1.65 |
| Organic pigments B | 0.55 | 18.6 | 1.48 |
| Organic pigments C | 0.74 | 11.2 | 1.85 |

| Organic pigments | Properties of organic pigments Hue: L* value (–) | a* value (–) | b* value (–) | C* value (–) |
|---|---|---|---|---|
| Organic pigments A | 17.7 | 9.7 | −23.4 | 25.4 |
| Organic pigments B | 39.3 | 49.2 | 19.8 | 53.0 |
| Organic pigments C | 65.4 | − 6.9 | 59.4 | 59.8 |

TABLE 3

| Examples | Kind of core particles |
|---|---|
| Example 10 | Core particles 1 |
| Example 11 | Core particles 2 |
| Example 12 | Core particles 3 |
| Example 13 | Core particles 1 |
| Example 14 | Core particles 2 |
| Example 15 | Core particles 3 |
| Example 16 | Core particles 1 |
| Example 17 | Core particles 2 |
| Example 18 | Core particles 3 |
| Example 19 | Core particles 1 |
| Example 20 | Core particles 1 |

TABLE 3-continued

| | |
|---|---|
| Example 21 | Core particles 3 |
| Example 22 | Core particles 3 |
| Example 23 | Core particles 1 |
| Example 24 | Core particles 1 |

| Examples | Production of colorant Coating step with gluing agent Additives: Kind | Amount added (wt. part) |
|---|---|---|
| Example 10 | Methyl triethoxysilane | 1.0 |
| Example 11 | Methyl triethoxysilane | 5.0 |
| Example 12 | Methyl trimethoxysilane | 1.0 |
| Example 13 | Phenyl triethoxysilane | 3.0 |
| Example 14 | Dimethyl dimethoxysilane | 10.0 |
| Example 15 | Methyl triethoxysilane | 1.0 |
| Example 16 | Methyl trimethoxysilane | 3.0 |
| Example 17 | Methyl hydrogen polysiloxane | 1.0 |
| Example 18 | Phenyl triethoxysilane | 2.0 |
| Example 19 | Methyl triethoxysilane | 1.0 |
| Example 20 | Methyl triethoxysilane | 1.0 |
| Example 21 | Methyl trimethoxysilane | 1.0 |
| Example 22 | Methyl trimethoxysilane | 1.0 |
| Example 23 | γ-aminopropyl triethoxysilane | 1.5 |
| Example 24 | Polyvinyl alcohol | 2.0 |

| Examples | Production of colorant Coating step with gluing agent: Edge runner treatment: Linear load (N/cm) | (Kg/cm) | Time (min.) | Coating amount (calculated as C) (wt. %) |
|---|---|---|---|---|
| Example 10 | 588 | 60 | 30 | 0.06 |
| Example 11 | 294 | 30 | 30 | 0.32 |
| Example 12 | 392 | 40 | 45 | 0.08 |
| Example 13 | 588 | 60 | 60 | 1.05 |
| Example 14 | 441 | 45 | 120 | 1.81 |
| Example 15 | 588 | 60 | 30 | 0.06 |
| Example 16 | 588 | 60 | 60 | 0.25 |
| Example 17 | 735 | 75 | 30 | 0.27 |
| Example 18 | 294 | 30 | 60 | 0.71 |
| Example 19 | 588 | 60 | 30 | 0.06 |
| Example 20 | 588 | 60 | 30 | 0.06 |
| Example 21 | 392 | 40 | 45 | 0.08 |
| Example 22 | 392 | 40 | 45 | 0.08 |
| Example 23 | 588 | 60 | 30 | 0.24 |
| Example 24 | 392 | 40 | 30 | 1.07 |

| Examples | Production of colorant Adhesion step with organic pigments Organic pigments: Kind | Amount adhered (wt. part) |
|---|---|---|
| Example 10 | A | 100.0 |
| Example 11 | A | 50.0 |
| Example 12 | A | 50.0 |
| Example 13 | B | 150.0 |
| Example 14 | B | 75.0 |
| Example 15 | B | 75.0 |
| Example 16 | C | 200.0 |
| Example 17 | C | 80.0 |
| Example 18 | C | 200.0 |
| Example 19 | B | 100.0 |
| Example 20 | C | 100.0 |
| Example 21 | B | 50.0 |
| Example 22 | C | 50.0 |
| Example 23 | A | 100.0 |
| Example 24 | A | 100.0 |

TABLE 3-continued

| | Production of colorant Adhesion step with organic pigments | | | |
|---|---|---|---|---|
| | Edge runner treatment | | | Amount adhered |
| | Linear load | | Time | (calculated as C) |
| Examples | (N/cm) | (Kg/cm) | (min.) | (wt. %) |
| Example 10 | 588 | 60 | 60 | 33.20 |
| Example 11 | 588 | 60 | 30 | 22.04 |
| Example 12 | 294 | 30 | 60 | 22.11 |
| Example 13 | 441 | 45 | 60 | 35.16 |
| Example 14 | 735 | 75 | 180 | 24.89 |
| Example 15 | 588 | 60 | 45 | 25.22 |
| Example 16 | 294 | 30 | 120 | 37.95 |
| Example 17 | 588 | 60 | 120 | 25.06 |
| Example 18 | 294 | 30 | 60 | 38.03 |
| Example 19 | 588 | 60 | 60 | 29.06 |
| Example 20 | 588 | 60 | 60 | 28.28 |
| Example 21 | 294 | 30 | 60 | 19.34 |
| Example 22 | 294 | 30 | 60 | 18.79 |
| Example 23 | 588 | 60 | 60 | 33.22 |
| Example 24 | 588 | 60 | 60 | 33.25 |

TABLE 4

| Comparative Examples | Kind of core particles |
|---|---|
| Comparative Examples 1 | Core particles 1 |
| Comparative Examples 2 | Core particles 1 |
| Comparative Examples 3 | Core particles 1 |
| Comparative Examples 4 | Core particles 1 |
| Comparative Examples 5 | Core particles 1 |
| Comparative Examples 6 | Core particles 1 |
| Comparative Examples 7 | Core particles 1 |

| | Production of colorant Coating step with gluing agent Additives | |
|---|---|---|
| Comparative Examples | Kind | Amount added (wt. part) |
| Comparative Examples 1 | — | — |
| Comparative Examples 2 | Methyl triethoxysilane | 0.005 |
| Comparative Examples 3 | Methyl triethoxysilane | 1.0 |
| Comparative Examples 4 | Methyl triethoxysilane | 1.0 |
| Comparative Examples 5 | — | — |
| Comparative Examples 6 | — | — |
| Comparative Examples 7 | — | — |

| | Production of colorant Coating step with gluing agent | | | |
|---|---|---|---|---|
| | Edge runner treatment | | | Coating amount |
| Comparative | Linear load | | Time | (calculated as C) |
| Examples | (N/cm) | (Kg/cm) | (min.) | (wt. %) |
| Comparative Examples 1 | — | — | — | — |
| Comparative Examples 2 | 588 | 60 | 30 | — |
| Comparative Examples 3 | 588 | 60 | 30 | 0.06 |

TABLE 4-continued

| | | | | |
|---|---|---|---|---|
| Comparative Examples 4 | 588 | 60 | 30 | 0.06 |
| Comparative Examples 5 | — | — | — | — |
| Comparative Examples 6 | — | — | — | — |
| Comparative Examples 7 | — | — | — | — |

| | Production of colorant Adhesion step with organic pigments Organic pigments | |
|---|---|---|
| Comparative Examples | Kind | Amount adhered (wt. part) |
| Comparative Examples 1 | A | 50.0 |
| Comparative Examples 2 | A | 50.0 |
| Comparative Examples 3 | A | 1000.0 |
| Comparative Examples 4 | A | 0.5 |
| Comparative Examples 5 | A | 100.0 |
| Comparative Examples 6 | B | 100.0 |
| Comparative Examples 7 | C | 100.0 |

| | Production of colorant Adhesion step with organic pigments | | | |
|---|---|---|---|---|
| | Edge runner treatment | | | Amount adhered |
| Comparative | Linear load | | Time | (calculated as C) |
| Examples | (N/cm) | (Kg/cm) | (min.) | (wt. %) |
| Comparative Examples 1 | 588 | 60 | 30 | 22.12 |
| Comparative Examples 2 | 588 | 60 | 30 | 22.01 |
| Comparative Examples 3 | 588 | 60 | 30 | 60.47 |
| Comparative Examples 4 | 588 | 60 | 30 | 0.31 |
| Comparative Examples 5 | 588 | 60 | 60 | 33.19 |
| Comparative Examples 6 | 588 | 60 | 60 | 29.07 |
| Comparative Examples 7 | 588 | 60 | 60 | 28.26 |

TABLE 5

| | Properties of colorant | | |
|---|---|---|---|
| Examples | Average particle diameter ($\mu$m) | Sphericity (–) | BET specific surface area value ($m^2/g$) |
| Example 10 | 0.025 | 1.02 | 136.2 |
| Example 11 | 0.015 | 1.28 | 231.2 |
| Example 12 | 0.061 | 1.23 | 29.4 |
| Example 13 | 0.027 | 1.03 | 121.3 |
| Example 14 | 0.016 | 1.28 | 200.3 |
| Example 15 | 0.062 | 1.23 | 30.1 |
| Example 16 | 0.028 | 1.04 | 100.3 |
| Example 17 | 0.016 | 1.29 | 183.2 |
| Example 18 | 0.067 | 1.24 | 34.6 |
| Example 19 | 0.025 | 1.03 | 124.3 |
| Example 20 | 0.025 | 1.03 | 111.6 |
| Example 21 | 0.061 | 1.23 | 34.5 |
| Example 22 | 0.061 | 1.23 | 28.9 |
| Example 23 | 0.025 | 1.03 | 134.6 |
| Example 24 | 0.025 | 1.03 | 133.2 |

TABLE 5-continued

| Examples | Properties of colorant | |
|---|---|---|
| | Specific gravity (–) | Fluidity index (–) |
| Example 10 | 1.92 | 63 |
| Example 11 | 2.17 | 58 |
| Example 12 | 3.32 | 48 |
| Example 13 | 1.77 | 65 |
| Example 14 | 2.02 | 58 |
| Example 15 | 3.01 | 49 |
| Example 16 | 1.96 | 66 |
| Example 17 | 2.17 | 59 |
| Example 18 | 2.62 | 50 |
| Example 19 | 1.83 | 62 |
| Example 20 | 2.01 | 63 |
| Example 21 | 3.25 | 48 |
| Example 22 | 3.37 | 48 |
| Example 23 | 1.91 | 62 |
| Example 24 | 1.91 | 63 |

| Examples | Properties of colorant Hue | | | |
|---|---|---|---|---|
| | L* value (–) | a* value (–) | b* value (–) | C* value (–) |
| Example 10 | 33.9 | 11.2 | −22.9 | 25.5 |
| Example 11 | 48.5 | 10.5 | −21.8 | 24.2 |
| Example 12 | 47.2 | 10.7 | −21.5 | 24.0 |
| Example 13 | 46.1 | 48.1 | 19.0 | 51.7 |
| Example 14 | 57.3 | 47.3 | 17.3 | 50.4 |
| Example 15 | 54.4 | 47.9 | 16.9 | 50.8 |
| Example 16 | 72.7 | −5.9 | 58.7 | 59.0 |
| Example 17 | 78.8 | −4.4 | 56.1 | 56.3 |
| Example 18 | 71.9 | −6.0 | 58.6 | 58.9 |
| Example 19 | 47.3 | 47.5 | 16.8 | 50.4 |
| Example 20 | 77.3 | −5.3 | 57.0 | 57.2 |
| Example 21 | 58.3 | 47.0 | 16.5 | 49.8 |
| Example 22 | 79.1 | −4.3 | 55.9 | 56.1 |
| Example 23 | 34.1 | 11.3 | −23.0 | 25.6 |
| Example 24 | 34.2 | 11.2 | −23.1 | 25.7 |

| Examples | Properties of colorant | |
|---|---|---|
| | Tinting strength (%) | Desorption percentage of organic pigments (%) |
| Example 10 | 136 | 7.2 |
| Example 11 | 132 | 5.7 |
| Example 12 | 131 | 6.1 |
| Example 13 | 143 | 7.6 |
| Example 14 | 135 | 5.9 |
| Example 15 | 135 | 6.0 |
| Example 16 | 154 | 8.1 |
| Example 17 | 136 | 6.3 |
| Example 18 | 150 | 8.4 |
| Example 19 | 138 | 6.6 |
| Example 20 | 137 | 6.5 |
| Example 21 | 132 | 5.5 |
| Example 22 | 134 | 6.0 |
| Example 23 | 135 | 7.8 |
| Example 24 | 136 | 7.6 |

TABLE 6

| Comparative Examples | Properties of colorant | | |
|---|---|---|---|
| | Average particle diameter (μm) | Sphericity (–) | BET specific surface area value ($m^2/g$) |
| Comparative Examples 1 | 0.022 | 1.02 | 180.7 |
| Comparative Examples 2 | 0.022 | 1.02 | 182.9 |

TABLE 6-continued

| | | | |
|---|---|---|---|
| Comparative Examples 3 | 0.038 | — | 86.5 |
| Comparative Examples 4 | 0.021 | 1.02 | 197.3 |
| Comparative Examples 5 | 0.022 | 1.02 | 133.9 |
| Comparative Examples 6 | 0.022 | 1.02 | 110.4 |
| Comparative Examples 7 | 0.022 | 1.03 | 103.9 |

| Comparative Examples | Properties of colorant | |
|---|---|---|
| | Specific gravity (–) | Fluidity index (–) |
| Comparative Examples 1 | 2.01 | 43 |
| Comparative Examples 2 | 2.01 | 44 |
| Comparative Examples 3 | 1.70 | 41 |
| Comparative Examples 4 | 2.19 | 58 |
| Comparative Examples 5 | 1.92 | 41 |
| Comparative Examples 6 | 1.84 | 42 |
| Comparative Examples 7 | 2.02 | 40 |

| Comparative Examples | Properties of colorant Hue | | | |
|---|---|---|---|---|
| | L* value (–) | a* value (–) | b* value (–) | C* value (–) |
| Comparative Examples 1 | 50.2 | 10.0 | −20.1 | 22.5 |
| Comparative Examples 2 | 50.9 | 10.1 | −20.4 | 22.8 |
| Comparative Examples 3 | 25.6 | 9.9 | −23.1 | 25.1 |
| Comparative Examples 4 | 91.8 | 6.5 | −15.2 | 16.5 |
| Comparative Examples 5 | 34.5 | 11.0 | −21.6 | 24.2 |
| Comparative Examples 6 | 47.6 | 46.5 | 16.3 | 49.3 |
| Comparative Examples 7 | 77.6 | −5.1 | 56.2 | 56.4 |

| Comparative Examples | Properties of colorant | |
|---|---|---|
| | Tinting strength (%) | Desorption percentage of organic pigments (%) |
| Comparative Examples 1 | 108 | 68.2 |
| Comparative Examples 2 | 110 | 50.6 |
| Comparative Examples 3 | 233 | 53.4 |
| Comparative Examples 4 | 12 | — |
| Comparative Examples 5 | 100 | 70.2 |
| Comparative Examples 6 | 100 | 69.6 |
| Comparative Examples 7 | 100 | 71.2 |

TABLE 7

| Examples | Production of color toner Colorant | |
|---|---|---|
| | Kind | Amount blended (wt. part) |
| Example 25 | Example 10 | 15.0 |
| Example 26 | Example 11 | 15.0 |
| Example 27 | Example 12 | 15.0 |
| Example 28 | Example 13 | 15.0 |
| Example 29 | Example 14 | 15.0 |
| Example 30 | Example 15 | 15.0 |
| Example 31 | Example 16 | 15.0 |
| Example 32 | Example 17 | 15.0 |
| Example 33 | Example 18 | 15.0 |
| Example 34 | Example 10 | 10.0 |
| Example 35 | Example 19 | 10.0 |
| Example 36 | Example 20 | 10.0 |
| Example 37 | Example 12 | 10.0 |
| Example 38 | Example 21 | 10.0 |
| Example 39 | Example 22 | 10.0 |
| Example 40 | Example 23 | 10.0 |
| Example 41 | Example 24 | 10.0 |

| Examples | Production of color toner Binder resin | |
|---|---|---|
| | Kind | Amount blended (wt. part) |
| Example 25 | Styrene-acrylic copolymer resin | 76.5 |
| Example 26 | Styrene-acrylic copolymer resin | 76.5 |
| Example 27 | Styrene-acrylic copolymer resin | 76.5 |
| Example 28 | Styrene-acrylic copolymer resin | 76.5 |
| Example 29 | Styrene-acrylic copolymer resin | 76.5 |
| Example 30 | Styrene-acrylic copolymer resin | 76.5 |
| Example 31 | Styrene-acrylic copolymer resin | 76.5 |
| Example 32 | Styrene-acrylic copolymer resin | 76.5 |
| Example 33 | Styrene-acrylic copolymer resin | 76.5 |
| Example 34 | Polyester resin | 85.0 |
| Example 35 | Polyester resin | 85.0 |
| Example 36 | Polyester resin | 85.0 |
| Example 37 | Polyester resin | 85.0 |
| Example 38 | Polyester resin | 85.0 |
| Example 39 | Polyester resin | 85.0 |
| Example 40 | Polyester resin | 85.0 |
| Example 41 | Polyester resin | 85.0 |

TABLE 8

| Comparative Examples | Production of color toner Colorant | |
|---|---|---|
| | Kind | Amount blended (wt. part) |
| Comparative Example 8 | Comparative Example 1 | 15.0 |
| Comparative Example 9 | Comparative Example 2 | 15.0 |
| Comparative Example 10 | Comparative Example 3 | 15.0 |
| Comparative Example 11 | Comparative Example 4 | 15.0 |
| Comparative Example 12 | Comparative Example 5 | 10.0 |
| Comparative Example 13 | Comparative Example 6 | 10.0 |
| Comparative Example 14 | Comparative Example 7 | 10.0 |

| Comparative Examples | Production of color toner Binder resin | |
|---|---|---|
| | Kind | Amount blended (wt. part) |
| Comparative Example 8 | Styrene-acrylic copolymer resin | 76.5 |
| Comparative Example 9 | Styrene-acrylic copolymer resin | 76.5 |
| Comparative Example 10 | Styrene-acrylic copolymer resin | 76.5 |
| Comparative Example 11 | Styrene-acrylic copolymer resin | 76.5 |
| Comparative Example 12 | Polyester resin | 85.0 |

TABLE 8-continued

| | | |
|---|---|---|
| Comparative Example 13 | Polyester resin | 85.0 |
| Comparative Example 14 | Polyester resin | 85.0 |

TABLE 9

| Examples | Properties of color toner | | |
|---|---|---|---|
| | Average particle diameter (μm) | Dispersibility (–) | Fluidity index (–) |
| Example 25 | 9.9 | 5 | 87 |
| Example 26 | 9.8 | 5 | 85 |
| Example 27 | 9.6 | 4 | 76 |
| Example 28 | 10.1 | 5 | 88 |
| Example 29 | 10.0 | 5 | 86 |
| Example 30 | 9.8 | 4 | 78 |
| Example 31 | 10.0 | 5 | 89 |
| Example 32 | 9.9 | 5 | 86 |
| Example 33 | 9.6 | 4 | 78 |
| Example 34 | 9.6 | 5 | 88 |
| Example 35 | 9.9 | 5 | 86 |
| Example 36 | 10.0 | 5 | 87 |
| Example 37 | 9.8 | 4 | 76 |
| Example 38 | 9.6 | 4 | 75 |
| Example 39 | 9.8 | 4 | 76 |
| Example 40 | 9.9 | 5 | 85 |
| Example 41 | 9.9 | 5 | 86 |

| Examples | Properties of color toner Hue | | | |
|---|---|---|---|---|
| | L* value (–) | a* value (–) | b* value (–) | C* value (–) |
| Example 25 | 35.1 | 11.4 | −23.0 | 25.7 |
| Example 26 | 49.7 | 10.6 | −21.9 | 24.3 |
| Example 27 | 48.8 | 10.8 | −21.5 | 24.1 |
| Example 28 | 47.4 | 48.4 | 18.9 | 52.0 |
| Example 29 | 59.3 | 47.5 | 17.1 | 50.5 |
| Example 30 | 56.0 | 48.1 | 16.8 | 50.9 |
| Example 31 | 73.8 | −5.6 | 58.6 | 58.9 |
| Example 32 | 80.2 | −4.3 | 55.9 | 56.1 |
| Example 33 | 72.9 | −5.9 | 58.5 | 58.8 |
| Example 34 | 35.0 | 11.1 | −22.9 | 25.4 |
| Example 35 | 48.4 | 47.9 | 17.1 | 50.9 |
| Example 36 | 78.5 | −4.8 | 56.1 | 56.3 |
| Example 37 | 48.6 | 10.5 | −21.3 | 23.7 |
| Example 38 | 59.9 | 46.5 | 16.6 | 49.4 |
| Example 39 | 80.3 | −3.8 | 55.1 | 55.2 |
| Example 40 | 35.2 | 11.2 | −23.1 | 25.7 |
| Example 41 | 35.0 | 11.0 | −22.9 | 25.4 |

TABLE 10

| Comparative Examples | Properties of color toner | | |
|---|---|---|---|
| | Average particle diameter (μm) | Dispersibility (–) | Fluidity index (–) |
| Comparative Example 8 | 9.6 | 2 | 65 |
| Comparative Example 9 | 9.8 | 2 | 66 |
| Comparative Example 10 | 10.1 | 1 | 61 |
| Comparative Example 11 | 9.7 | 4 | 79 |
| Comparative Example 12 | 10.0 | 2 | 64 |
| Comparative Example 13 | 9.9 | 2 | 63 |
| Comparative Example 14 | 9.7 | 2 | 64 |

TABLE 10-continued

| Comparative Examples | Properties of color toner Hue L* value (–) | a* value (–) | b* value (–) | C* value (–) |
|---|---|---|---|---|
| Comparative Example 8 | 52.8 | 9.6 | −19.8 | 22.0 |
| Comparative Example 9 | 52.2 | 9.8 | −20.0 | 22.3 |
| Comparative Example 10 | 27.5 | 9.5 | −22.4 | 24.3 |
| Comparative Example 11 | 92.4 | 5.4 | −14.3 | 15.3 |
| Comparative Example 12 | 35.3 | 11.2 | −21.8 | 24.5 |
| Comparative Example 13 | 48.5 | 44.3 | 15.8 | 47.0 |
| Comparative Example 14 | 78.6 | −4.6 | 54.3 | 54.5 |

TABLE 11

| Examples and Comparative Examples | Developing method: Kind of developing method | Combination of color toners |
|---|---|---|
| Example 42 | Developing method 1 | Example 34<br>Example 35<br>Example 36 |
| Example 43 | Developing method 2 | Example 37<br>Example 38<br>Example 39 |
| Comparative Example 15 | Developing method 1 | Comparative Example 12<br>Comparative Example 13<br>Comparative Example 14 |

| Examples and Comparative Examples | Image properties: Image density (–) | Image durability (%) | Image fogging ΔL* value (–) |
|---|---|---|---|
| Example 42 | 1.30 | 3.4 | 1.56 |
| | 1.29 | 3.5 | 1.58 |
| | 1.28 | 3.6 | 1.61 |
| Example 43 | 1.26 | 4.5 | 2.11 |
| | 1.25 | 4.3 | 2.13 |
| | 1.25 | 4.2 | 2.10 |
| Comparative Example 15 | 0.96 | 14.8 | 5.62 |
| | 0.98 | 15.6 | 5.78 |
| | 0.96 | 15.8 | 6.13 |

What is claimed is:

1. A color toner comprising: a binder resin, and a colorant having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

2. A color toner according to claim 1, wherein said gluing agent is an organosilicon compound, a coupling agent, an oligomer compound or a polymer compound.

3. A color toner according to claim 1, wherein said gluing agent is at least one compound selected from the group consisting of:

organosilicon compound selected from the group consisting of:

(1) organosilane compounds obtainable from alkoxysilane compounds, (2) polysiloxanes or modified polysiloxanes, and (3) fluoroalkyl organosilane compounds obtainable form fluoroalkylsilane compounds, a silane-based coupling agent, a titanate-based coupling agent, an aluminate-based coupling agent, and zirconate-based coupling agent.

4. A color toner according to claim 1, wherein said gluing agent is organosilane compounds obtainable from alkoxysilane compounds, or polysiloxanes.

5. A color toner according to claim 1, wherein said colorant has a BET specific surface area value of 30 to 500 $m^2/g$, a hue C* value of not less than 20, a specific gravity of 1.3 to 3.5, and a fluidity index of not less than 45.

6. A color toner according to claim 1, which has an average particle diameter of 3 to 25 μm, a C* value of not less than 20, and a fluidity index of 76 to 100.

7. A color toner according to claim 1, wherein the colorant content is 1.2 to 20.0% by weight based on the weight of the color toner.

8. A color toner according to claim 1, wherein said binder resin is selected from the group consisting of polyester-based resins, epoxy-based resins, polyolefin-based resins, polyurethane-based resins, vinyl-based polymers and styrene-butadiene copolymers.

9. A color toner according to claim 1, wherein said extender pigments are selected from the group consisting of fine silica particles such as silica powder, white carbon, fine silicate powder and diatomaceous earth, clay, calcium carbonate, barium sulfate such as precipitated barium sulfate, alumina white, talc, transparent titanium oxide, and satin white.

10. A color toner according to claim 1, wherein said extender pigments have a sphericity (average particle diameter/average minimum diameter) of from 1.0 to less than 2.0, an average particle diameter of 0.005 to 0.30 μm and a specific gravity of 1.3 to 4.5.

11. A colorant for color toner, having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

12. A color toner having an average particle diameter of preferably 3 to 25 μm, a C* value of not less than 20, and a fluidity index of 76 to 100, and comprising: a binder resin, and a colorant having an average particle diameter of 0.005 to 0.30 μm, comprising:

extender pigments, a gluing agent-coating layer formed on surface of the extender pigment, and an organic pigment coat formed onto the gluing agent-coating layer in an amount of 1 to 500 parts by weight based on 100 parts by weight of the extender pigments.

* * * * *